US007743804B2

(12) United States Patent
Thomaschewski

(10) Patent No.: US 7,743,804 B2
(45) Date of Patent: Jun. 29, 2010

(54) METHOD AND DEVICE FOR PRODUCING SLOTS IN WORKPIECES

(75) Inventor: Walter Thomaschewski, Filderstadt (DE)

(73) Assignee: C. & E. Fein GmbH (DE)

( * ) Notice: Subject to any disclaimer, the term of this patent is extended or adjusted under 35 U.S.C. 154(b) by 1027 days.

(21) Appl. No.: 11/447,831

(22) Filed: Jun. 6, 2006

(65) Prior Publication Data

US 2007/0034296 A1 Feb. 15, 2007

(30) Foreign Application Priority Data

Jun. 6, 2005 (DE) ..... 10 2005 027 195

(51) Int. Cl.
*B27C 5/00* (2006.01)

(52) U.S. Cl. ..... 144/154.5

(58) Field of Classification Search ..... 144/136.95, 144/154.5; 30/392–394; 83/425.4, 508.2
See application file for complete search history.

(56) References Cited

U.S. PATENT DOCUMENTS

| | | | | | |
|---|---|---|---|---|---|
| D194,736 | S | * | 2/1963 | Godfrey | D8/64 |
| 3,943,934 | A | | 3/1976 | Bent | 128/317 |
| 4,858,662 | A | * | 8/1989 | Bosten et al. | 144/136.95 |
| 4,858,663 | A | * | 8/1989 | Bosten et al. | 144/136.95 |
| 4,913,204 | A | * | 4/1990 | Moores et al. | 144/136.95 |
| 4,971,122 | A | * | 11/1990 | Sato et al. | 144/136.95 |
| 5,257,654 | A | * | 11/1993 | Bean et al. | 144/136.95 |
| 5,273,091 | A | * | 12/1993 | Shibata | 144/136.95 |
| 5,601,483 | A | * | 2/1997 | Rudolf et al. | 451/359 |
| 5,706,874 | A | * | 1/1998 | Brazell et al. | 144/136.95 |
| 5,846,244 | A | * | 12/1998 | Cripe | 606/82 |
| 5,865,230 | A | * | 2/1999 | Smith et al. | 144/136.95 |
| 5,916,221 | A | | 6/1999 | Hodorek et al. | 606/89 |
| 5,921,298 | A | * | 7/1999 | Miyamoto | 144/136.95 |
| 5,988,240 | A | * | 11/1999 | Markus | 144/136.95 |
| 6,006,802 | A | * | 12/1999 | Smith et al. | 144/136.95 |
| 6,125,896 | A | * | 10/2000 | Smith et al. | 144/136.95 |
| 6,260,591 | B1 | * | 7/2001 | George et al. | 144/136.95 |
| 6,336,483 | B1 | * | 1/2002 | Smith et al. | 144/136.95 |

(Continued)

FOREIGN PATENT DOCUMENTS

DE 40 36 904 C1 5/1992

(Continued)

OTHER PUBLICATIONS

European Search Report, Oct. 12, 2006, 4 pages.

*Primary Examiner*—Shelley Self
(74) *Attorney, Agent, or Firm*—St. Onge Steward Johnston & Reens LLC

(57) ABSTRACT

A method and a device for producing slots in workpieces are disclosed. An oscillatory drive is provided, on the output shaft of which a saw blade is accommodated by one end, and at the other end of which a cutting edge is provided. The oscillatory drive is positioned on a workpiece with a defined angle between the workpiece surface and the saw blade, the saw blade being driven in an oscillating manner and moved along a guide in a direction extending radially in relation to the output shaft. Connecting elements can be inserted into slots produced on two workpieces in this way so that they match and can be adhesively bonded to the two workpieces, in order to produce a permanent and precise connection between the workpieces.

5 Claims, 2 Drawing Sheets

U.S. PATENT DOCUMENTS

| | | | | |
|---|---|---|---|---|
| 6,422,275 | B1 * | 7/2002 | Smith et al. | 144/136.95 |
| 6,612,349 | B2 * | 9/2003 | Smith et al. | 144/136.95 |
| 6,896,016 | B1 * | 5/2005 | Smith et al. | 144/136.95 |

FOREIGN PATENT DOCUMENTS

| | | | |
|---|---|---|---|
| DE | 198 30 096 | C2 | 1/2001 |
| DE | 199 38 106 | C1 | 4/2001 |
| DE | 202 09 002 | U1 | 10/2002 |
| DE | 102 50 096 | A1 | 5/2004 |
| JP | 2217201 | A | 8/1990 |
| JP | 6026801 | B | 4/1994 |
| JP | 11179704 | A | 7/1999 |
| JP | 2000005049 | A | 1/2000 |

* cited by examiner 10
12
13
14
15
16
17
18
20
22
24
26
28
30
32
34
36
37
38
39
40
42
44
46
48
50
52
62
64
66
68
70
74
0
15
30
45
60
75

METHOD AND DEVICE FOR PRODUCING SLOTS IN WORKPIECES

BACKGROUND OF THE INVENTION

The invention relates to a method of producing slots in workpieces. The invention also relates to a method of connecting two workpieces. Finally, the invention relates to a device for producing slots in workpieces.

For connecting workpieces, in wood-frame construction in particular, a system referred to as the Lamello jointing system is known. This involves using a circular saw blade to cut slots in the form of segments of a circle into two parts made of wood that are to be connected to each other, inserting into these slots small flat, approximately lenticular wooden plates which are also known as biscuits, and gluing them with wood glue. The biscuits swell under the effect of the wood glue and in this way lead to a permanent, solid connection between the two components.

Although connections of this type are very strong as a result of the gluing, there is the disadvantage that it is scarcely possible for relatively small workpieces to be connected in confined spaces because of the segmental slots.

Metal connectors for connecting adjacent workpieces by means of wood glue are indeed also known, disclosed by DE 102 50 096 A1, the connecting elements being coated with a wood veneer. In this way, the connecting elements inserted into assigned slots can likewise be connected to one another by means of wood glue.

However, here there is also the problem that, because the slots are produced by means of circular saw blades, a segmental shape is obtained, precluding connections in a confined space.

Furthermore, DE 199 38 106 C1 discloses a portable power tool with a stop, which has an oscillatory drive for intermittently driving the tool about a longitudinal axis of the output shaft and is provided with an adjustable stop for maintaining a minimum distance between the portable tool and a workpiece.

Although grinding or sawing work can in principle be carried out with such a tool, it does not allow precision slots to be produced in workpieces.

SUMMARY OF THE INVENTION

It is a first object of the invention to disclose a method of producing slots in workpieces with high precision.

It is a second object of the invention to disclose a method of producing slots in workpieces that allows to work on workpieces in regions difficult to access, such as in corner regions or close to walls.

It is a third object of the invention to disclose a method of producing slots of a substantially rectangular shape within workpieces.

It is a forth object of the invention to disclose a method of connecting two workpieces.

It is a fifth object of the invention to disclose a device for producing slots in workpieces with high precision.

These and other objects of the invention are achieved by a method of producing slots in workpieces comprising the following steps:

a. providing an oscillatory drive, on the output shaft of which a saw blade is accommodated by one end, and at the other end of which a cutting edge is provided;
b. positioning the oscillatory drive on a workpiece with a defined angle between the workpiece surface and the saw blade;

c. oscillatingly driving the saw blade; and
d. guiding the saw blade along a guide in a direction extending radially in relation to the output shaft.

The object of the invention is also achieved by a device for producing slots in workpieces, with an oscillatory drive, on the output shaft of which a saw blade is accommodated by one end, and at the second end of which a cutting edge is provided, with at least one stop face for positioning the saw blade at a defined angle with respect to a workpiece surface, and with a guide for displacing the saw blade in a direction extending radially in relation to the output shaft.

In this way, the object is achieved completely.

With the method according to the invention and the device according to the invention, slots can be produced in workpieces with a precise shape and along a precise path. Since the saw blade during the oscillatory driving is guided along a guide in a direction extending radially in relation to the output shaft, virtually straight slots can be produced in a surface of a workpiece.

Using this method, it is also possible according to the invention for at least two workpieces to be connected by the following steps:

a. producing slots aligned with one another on the workpieces by such a method;
b. inserting connector elements into two associated slots in each case; and
c. joining the workpieces together by adhesively bonding each connector element.

In this way, extremely precise, durable and reliable connections can be produced between workpieces.

At the same time, on account of the precision guidance, very thin components can also be connected to each other end-on.

In a preferred development of the invention, metal elements provided with a surface coating allowing gluing with wood glue are used as connector elements.

In this way it is possible in particular for components made of wood to be connected to one another by a conventional connecting technique that is known in principle, in that gluing takes place. Since, however, the connector elements consist of metal, they can be made much smaller than in the case of conventional connector elements. Equally, angled connections are also possible.

In the case of the method according to the invention, the saw blade is preferably driven in such a way that it oscillates back and forth about a longitudinal axis of the output shaft.

In this way, the vibrations are kept very small and approximately rectangular slots can be produced by correspondingly shaped saw blades.

For this purpose, according to a further refinement of the invention, the cutting edge is formed in such a way that it is straight, at least in certain portions.

The saw blade is preferably driven with a frequency of between 5000 and 30,000 oscillations per minute and preferably with a pivot angle of between 0.5° and 7°.

This permits good advancement and at the same time precision work.

In an advantageous development of the invention, the device according to the invention has a first stop face for supporting on the workpiece surface and a second stop face, the distance of which from a plane defined by the saw blade is adjustable.

In this way, the distance of the slot from a workpiece surface can be precisely preset and maintained.

In an additional development of this configuration, the second stop face is adjustable in its angle.

In this way, slots with which a connection of workpieces at various angles is made possible can be produced. Virtually any desired angles between 0 and 90°, or between 90° and 180°, can be achieved by a corresponding presetting.

According to a further refinement of the invention, a third stop face is provided, extending parallel to a radial plane of the output shaft.

In this way, the tool can also be guided on a plane outside the workpiece.

It goes without saying that the features of the invention mentioned above and those still to be explained below can be used not only in the combination respectively given but also in other combinations or on their own without departing from the scope of the present invention.

BRIEF DESCRIPTION OF THE DRAWINGS

Further features and advantages of the invention emerge from the following description of preferred exemplary embodiments with reference to the drawings, wherein.

DETAILED DESCRIPTION OF THE INVENTION

Figures 1, 3:
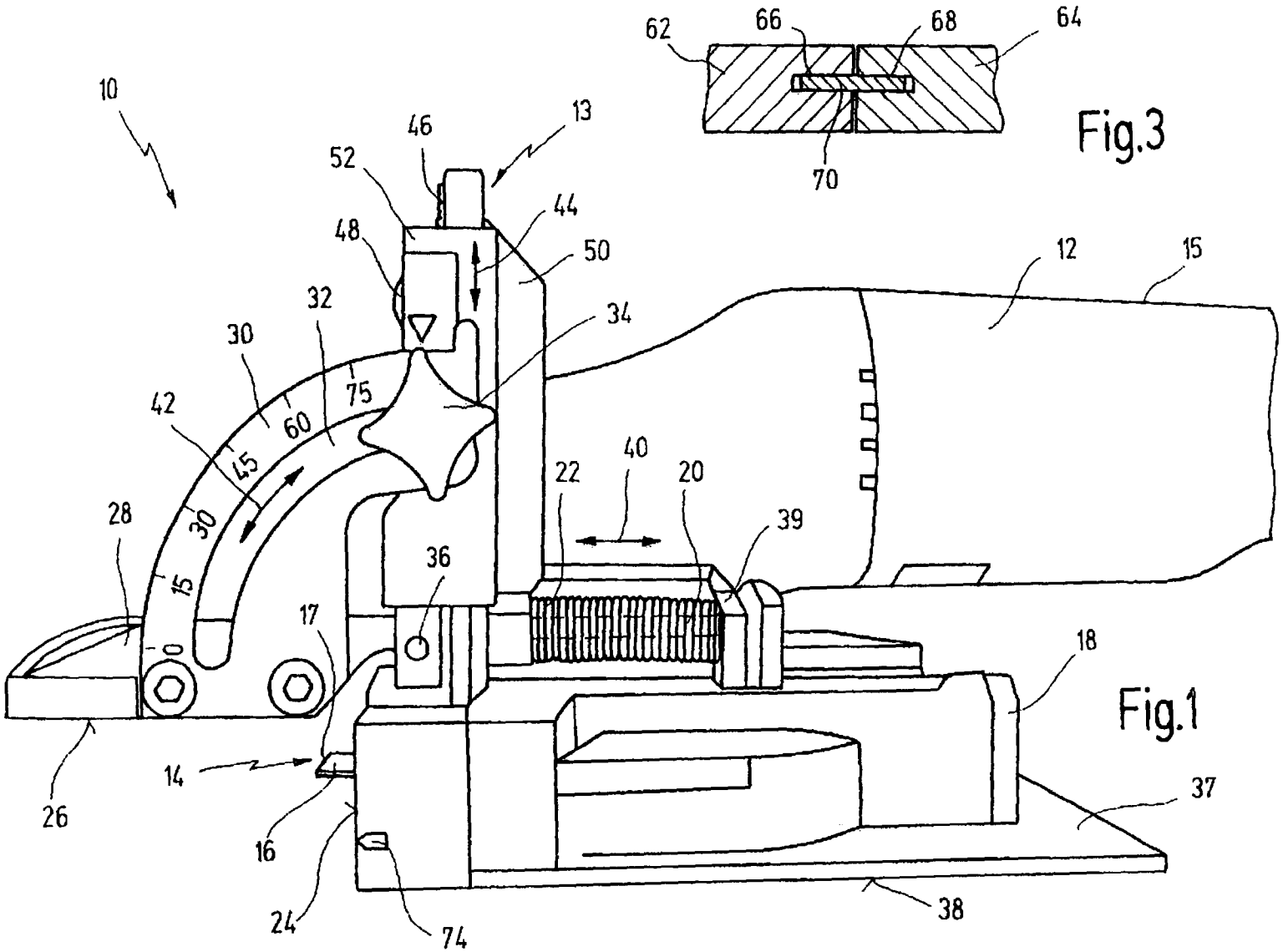
FIG. 1 shows a perspective side view of a device according to the invention.
FIG. 3 shows a partial section through two workpieces which are connected by a connector element according to the invention.
Figure 2:
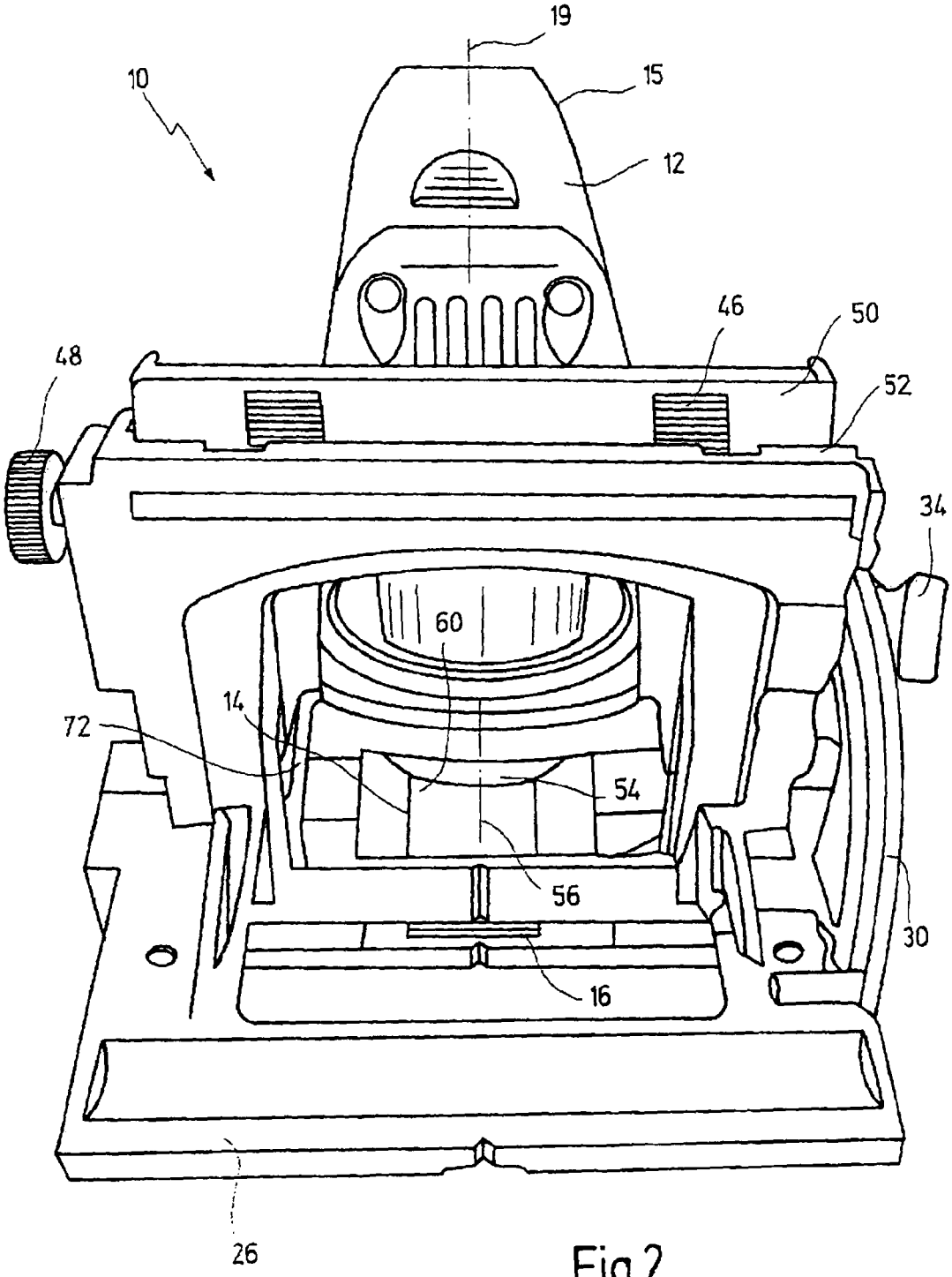
FIG. 2 shows a perspective front view of the device according to FIG. 1.

In FIGS. 1 and 2, a device according to the invention is denoted overall by the numeral 10. The device 10 has an oscillatory drive 12, which is fastened on a mount denoted overall by 13. The mount 13 permits precise guidance of the oscillatory drive along the surface of a workpiece.

The oscillatory drive 12 has a housing 15, which is designed as a handle and from the front end of which a output shaft 54 protrudes approximately at right angles (cf. FIG. 2).

The output shaft 54 of the oscillatory drive is driven in such a way that it oscillates back and forth about its longitudinal axis 56 with a high frequency, which can be set approximately between 5000 and 30,000 oscillations per minute, and a small pivot angle, which may be between approximately 0.5 and 7°. A saw blade 14 is fastened with its first end 60 (FIG. 2) on the output shaft 54 by means of a suitable positive connection and protrudes with its second end 16 (FIG. 1) from the output shaft 54 perpendicularly outwards.

In the present case, the saw blade 14 is rectangularly shaped and has at its second end 16 a straight cutting edge 17.

The mount 13 has a base body 18, which is connected to a planar base plate 37. On its outer side, facing a workpiece to be worked, the base body is terminated by a planar first stop face 24, which runs perpendicularly in relation to the base plate 37. Protruding upwards at right angles from the base body 18 is a flange 50. On this flange 50, a frame 52 is accommodated in such a way that it can move along two toothed racks 46 by means of an adjusting screw 48. A screw on the rear side of the frame 52 (not represented) serves for fixing.

Provided at the lower end of the frame 52 is a pivot axis 36, on which a bow 30 is held with its one end. The bow 30 has an arcuate slot 32 and can therefore be pivoted upwards about the pivot axis 36 and be fixed on the frame 52 at its other end by an adjusting screw 34, which extends through the slot 32. Fastened at the lower end of the bow 30 is a plate 28, at the lower end of which a second stop face 26 is formed. Therefore, by pivoting the plate 30 about the pivot axis 36, the angle between the second stop face 26 and the first stop face 24 can be adjusted infinitely variably between 90° and 180°, as indicated by the double-headed arrow 42.

Additionally formed on the outer side of the base plate 37 is a third stop face 38, which runs at right angles in relation to the first stop face 24.

The oscillatory drive 12 is adjustably accommodated on both sides on longitudinal guides 72 (cf. FIG. 2). These guides 72 extend parallel to the plate 37, and parallel to the main direction of extent 19 of the housing 15 of the oscillatory drive 12 and make it possible for the oscillatory drive 12 to be displaced linearly, so that with the saw blade 14 a corresponding advancement can be produced perpendicularly to the direction of extent of its cutting edge 17.

According to FIG. 1, additionally provided on the side of the mount 13 facing the viewer is a rod 20, on which a spring element 22 in the form of a spiral spring is held. In this case, one end of the spring element 22 is clamped on the flange 50, while the other end moves together with the oscillatory drive 12 with a block 39.

In this way, the spring element 22 is stressed when the oscillatory drive 12 moves in the direction of the first stop face 24.

The stressed position is represented in FIG. 1, the cutting edge 17 of the saw blade 14 already protruding by a considerable amount from the first stop face 24. If the oscillatory drive 12 is released, it moves back on the guides 72 under the action of the spring element 22 into a starting position.

The operating mode of the device according to the invention is thus as follows:

In order to produce a slot at a specific angle in a workpiece, the device 10 can be placed with a first stop face 24 against the front edge of a workpiece. By adjusting the frame 52 along the toothed rack 46 by means of the adjusting screw 48, the distance between the second stop face 26 and the saw blade 14 can be set. In a perpendicular side view, the saw blade 14 is at the level of the marking 74 (cf. FIG. 1). In addition, by pivoting the bow 30 about the pivot axis 36, the angle between the first stop face 24 and the second stop face 26 can be set between 90° and 180°, accompanied at the same time by a setting of the angle between the saw blade 14 and the surface of the workpiece. A slot can then be sawn into a workpiece by the oscillatorily driven saw blade 14, the oscillatory drive 12 being gradually advanced along the guides 72 counter to the action of the spring element 22.

In this way, a slot can be produced with a precise position and precise angular orientation with respect to the surface of the workpiece.

In a corresponding way, a further slot of a suitable form, size and positioning can be produced on an assigned second workpiece, which is to be joined together with the first workpiece.

Subsequently, the two workpieces 62, 64 can be joined together by a connector element 68, as schematically represented by FIG. 3.

A connecting element 70 in the form of a small plate is pushed between the two mutually aligned slots 66, 68 on the first workpiece 62 and on the second workpiece 64. The connecting element 70 preferably consists of metal and is coated with a wood veneer. Therefore, the connecting element 70 can be glued by means of wood glue in the two slots 66, 68, whereby an extremely solid and reliable connection is produced between the two workpieces 62, 64. Since the core of the connecting element 70 consists of metal, it has a high strength and, as a result of a possible rectangular formation of the saw blade 14, can likewise be rectangularly formed.

In this way, very solid and permanent connections can be produced between adjacent workpieces by means of relatively small connecting elements. This is readily possible both in edge regions and in corner regions of workpieces. Furthermore, angled connections can be produced between workpieces which form angles of 90° or angles other than that. In addition, deep and not particularly wide slots can be produced.

What is claimed is:

1. A device for producing slots in workpieces, comprising:

a base body having at least one flat guide surface;

an oscillatory drive being supported on said base body and having an output shaft;

a saw blade having a first end and a second end, the first end being connected to said output shaft, said second end comprising a cutting edge, wherein the saw blade is oscillatingly driven back and forth about a longitudinal axis of the output shaft;

at least a first stop face provided on said base body for positioning said saw blade at a defined angle with respect to a workpiece surface and at a defined distance from the workpiece surface; and a guide arranged on said base body for displacing the saw blade in a direction extending radially in relation to said output shaft.

2. The device of claim 1, further comprising a second stop face supported by said base body; and a longitudinal adjustment means for adjusting a distance between said first and second stop faces.

3. The device of claim 2, further comprising an angle adjustment means for adjusting an angle between said first and second stop faces.

4. The device of claim 3, further comprising a third stop face extending parallel to a radial plane of said output shaft.

5. The device of claim 1, wherein the cutting edge of the saw blade comprises at least one straight section.

* * * * *